United States Patent [19]

Garnett

[11] 4,183,747

[45] Jan. 15, 1980

[54] ELECTROPHOTOGRAPHIC RECORDING ELEMENT, CELLULOSE CARRIER IRRADIATED WITH IONIZING RADIATION, PROCESS AND PRODUCT

[76] Inventor: John L. Garnett, P.O. Box 1, Kensington, N.S.W., Australia

[21] Appl. No.: 595,678

[22] Filed: Jul. 14, 1975

[51] Int. Cl.[2] ..... G03G 5/04

[52] U.S. Cl. ..... 430/69; 427/324; 162/192; 427/35; 252/500; 427/74; 427/36

[58] Field of Search ..... 96/1.5, 1 PC, 427; 252/500; 427/35, 36, 38, 74–76, 85, 324, 326; 162/138, 192

[56] References Cited

U.S. PATENT DOCUMENTS 3,130,067 3/1964 Bulgin ..... 427/36

OTHER PUBLICATIONS

Nuclear Science Abstracts, vol. 18, #6, 8880; vol. 23, #20,40767.

*Primary Examiner*—John D. Welsh
*Attorney, Agent, or Firm*—Michael J. Striker

[57] ABSTRACT

An electrophotographic recording element having a paper carrier, in which the paper carrier has been rendered slightly electrically conductive by being subject to a dose of ionizing radiation of from $10^4$ to $10^8$ rads.

6 Claims, No Drawings

ELECTROPHOTOGRAPHIC RECORDING ELEMENT, CELLULOSE CARRIER IRRADIATED WITH IONIZING RADIATION, PROCESS AND PRODUCT

BACKGROUND OF THE INVENTION

The present invention relates to a process for the preparation of an electrophotographic recording element and a recording element so produced.

Electrographic processes involve the charging, as by a corona discharge, of a photo-conductive layer or coating, the selective local dissipation of the charge by exposing the recording element to light via the document to be copied, and development of the recording element by contact with a charged resinous toning powder or liquid which is subsequently fixed by fusion. The electrophotographic recording element for use in such a process comprises a carrier bearing a layer or coating of a photoconductive material. Materials posessing suitable photoconductive properties includes Selenium, Cadmium sulphide, and Zinc Oxide. These materials are conventionally coated onto a metal drum, as in the Xerox process, or onto paper. It has also been recently proposed in U.S. patent application Ser. No. 541,947 to form a graft copolymer having photoconductive properties by grafting a monomer such a N-vinyl cabazole onto a substrate such as cellulose.

SUMMARY OF THE INVENTION

It is desirable for the carrier to be at least slightly electrically conductive. Conventionally conductive tertiary salts are included in the carrier if it is made of an essentially insulating material such as cellulose. The present inventors have discovered that a cellulose carrier e.g. paper, may be readily made significantly more electrically conductive by subjecting the cellulose to an ionision radiation dose of from $10^4$ to $10^8$ rads and that this discovery has practical application in the field of electrophotography.

The present invention lies in the provision, in a process for the production of an electrophotographic recording element, of the step of delivering to a cellulosic carrier of the element an ionising radiation dose of from $10^4$ to $10^8$ rads prior to a surface of the carrier being rendered photoconductive.

In another aspect the present invention consists in an electrophotographic recording element comprising a cellulosic carrier, at least one surface of which is photoconductive, characterised in that the cellulosic carrier received an ionising radiation dose of from $10^4$ to $10^8$ rads prior to the said surface thereof being rendered photoconductive.

The cellulosic carrier is preferably paper, however other woven or non woven carriers formed largely or wholely of natural or regenerated cellulose may be used.

The ionision radiation may be of any available type and from any suitable source. $\beta$-rays, $\gamma$-rays, accelerated electrons and particles, X-rays, ionising ultraviolet radiation or mixtures thereof may conveniently be used. Such radiation may be furnished by atomic piles, particle accelerators, radio isotopes, X-ray equipment and the like. A radiation dose of from $10^4$ to $10^8$ rads is sufficient to produce a measurable increase in the conductivity of the cellulosic carrier without being so high as to bring about substantial degradation of preferred forms of cellulosic carriers. The dose rate is best selected according to economic criteria to produce the most efficient result.

A surface of the carrier may be rendered photoconductive either by having a layer of a conventional photoconductive such as zinc oxide applied thereto or alternatively a suitable monomer may be grafted to the surface of the carrier by a process as described in U.S. patent application Ser. No. 541,947.

Without wishing to be bound by this theory it is believed that the increased conductivity of the cellulosic carrier is due to the creation of trap radicals of very long life. These trap radicals are capable of movement within the cellulose matrix and it is this mobility which imparts the increased conductivity to the cellulose. It is surprising that the radiation effect produces trap radicals of such long life; other polymers studied showed a rapid dissipation of any increased conductivity during or following treatment with ionising radiation.

DESCRIPTION OF THE PREFERRED EMBODIMENTS

Table I and II set out hereunder show the effect of radiation doses of from $10^4$ to $10^8$ rads on the electrical conductivity of "dry" and "non-dry" cellulose.

TABLE I

| Conductivities of Cellulose Samples[a] (ND) | | | |
|---|---|---|---|
| | | Conductivity ($ohm^{-1}$ $cm^{-1}$) | |
| Irradiation Dose | Irradiation in Air | Irradiation under Vacuum | Irradiation in KI Solution |
| $10^4$ rads | $3.17 \times 10^{-16}$ | $3.00 \times 10^{-16}$ | $2.30 \times 10^{-16}$ |
| $10^6$ rads | $6.93 \times 10^{-16}$ | $7.10 \times 10^{-16}$ | $6.00 \times 10^{-16}$ |
| $10^8$ rads | $2.24 \times 10^{-14}$ | $2.60 \times 10^{-14}$ | $8.87 \times 10^{-15}$ |
| Cellulose | | $2.48 \times 10^{-16}$ | |

[a]Measured with gold guard electrode, ND = nondry.

TABLE II

| Conductivities of Cellulose Samples (P)[a] | | | |
|---|---|---|---|
| | | Conductivity ($ohm^{-1}$ $cm^{-1}$) | |
| Irradiation Dose | Irradiation in air | Irradiation under vacuum | Irradiation in KI solution |
| $10^4$ rads | $2.29 \times 10^{-16}$ | $2.07 \times 10^{-16}$ | $2.40 \times 10^{-16}$ |
| $10^6$ rads | $2.39 \times 10^{-16}$ | $2.11 \times 10^{-16}$ | $2.28 \times 10^{-16}$ |
| $10^8$ rads | $5.12 \times 10^{-16}$ | $5.08 \times 10^{-16}$ | $3.46 \times 10^{-16}$ |
| Cellulose | | $2,17 \times 10^{-16}$ | |

[a]Measured with gold guard electrode D=dry.

Cellulosic paper having an improved conductivity has been found to improve imaging in electrophotographic processes as compared with untreated papers.

What is claimed as new and desired to be protected by Letters Patent is set forth in the appended claims:

1. A process for the production of an electrophotographic recording element having a cellulosic carrier, the improvement comprising the steps of delivering to the cellulosic carrier an ionising radiation dose of from $10^4$ to $10^8$ rads and thereafter rendering a surface of the carrier photoconductive.

2. A process as claimed in claim 1 in which the cellulosic carrier is paper.

3. A process as claimed in claim 1 in which the ionising radiation is selected from the group consisting of $\beta$-rays, $\gamma$-rays, accelerated electrons and particles; ionising ultraviolet radiation and mixtures thereof.

4. An electrophotographic recording element comprising a cellulosic carrier having at least one photoconductive surface said carrier having an electrical conductivity in the range of $2.10^{-14}$–$5.10^{-16}$ $onm^{-1}cm^{-1}$ resulting from an ionising radiation dose of from $10^4$ to $10^8$ rads received prior to the said surface being rendered photoconductive.

5. An electrophotographic recording element as claimed in claim 4 in which the cellulosic carrier is paper.

6. An electrophotographic recording element as claimed in claim 4 in which the ionising radiation is selected from the group consisting of $\beta$-rays, $\gamma$-rays, accelerated electrons and particles, ionising ultraviolet radiation and mixtures thereof.

* * * * *